US006076242A

United States Patent [19]

Kasaoka et al.

[11] Patent Number: 6,076,242

[45] Date of Patent: Jun. 20, 2000

[54] HIGH AND-LOW PILES-REVEALING CUT PILE FABRIC CUT PILE FABRIC, HAVING RUGGED SURFACE WITH SNARLED PILES AND PROCESS FOR PRODUCING SAME

[75] Inventors: Katsuyuki Kasaoka, Ibaraki; Shigeru Takahashi, Osaka; Mitsuo Matsumoto; Akio Kimura, both of Ibaraki, all of Japan

[73] Assignee: Teijin Limited, Osaka, Japan

[21] Appl. No.: 09/125,195

[22] PCT Filed: Dec. 12, 1997

[86] PCT No.: PCT/JP97/04581

§ 371 Date: Aug. 13, 1998

§ 102(e) Date: Aug. 13, 1998

[87] PCT Pub. No.: WO98/26119

PCT Pub. Date: Jun. 18, 1998

[30] Foreign Application Priority Data

Dec. 13, 1996 [JP] Japan ..... 8-333450

[51] Int. Cl.[7] ..... D06C 7/02; D06C 11/00

[52] U.S. Cl. ..... 28/159; 428/89; 428/92

[58] Field of Search ..... 428/89, 88, 92; 28/159, 160, 243, 161, 162, 165, 166

[56] References Cited

U.S. PATENT DOCUMENTS

| | | | |
|---|---|---|---|
| 4,340,631 | 7/1982 | Endo et al. | 428/89 |
| 4,389,364 | 6/1983 | Endo et al. | 264/167 |
| 4,418,104 | 11/1983 | Kiyomura et al. | 428/15 |
| 4,461,791 | 7/1984 | Matsui et al. | 428/15 |
| 4,576,840 | 3/1986 | Murata et al. | 428/16 |
| 4,617,208 | 10/1986 | Cadenhead, Sr. | 28/15 |
| 5,284,009 | 2/1994 | Tung et al. | 428/92 |
| 5,609,935 | 3/1997 | Yamagata et al. | 428/89 |
| 5,618,624 | 4/1997 | Dinger et al. | 428/368 |
| 5,652,038 | 7/1997 | Geren | 428/92 |

FOREIGN PATENT DOCUMENTS

| | | |
|---|---|---|
| 0 728 860 A1 | 8/1996 | European Pat. Off. . |
| 35 25 441 A1 | 1/1987 | Germany . |
| S60-17144 | 1/1985 | Japan . |
| S63-203847 | 8/1988 | Japan . |
| H2-23616 | 5/1990 | Japan . |

*Primary Examiner*—Amy B. Vanatta
*Attorney, Agent, or Firm*—Sughrue, Mion, Zinn, Macpeak & Seas, PLLC

[57] ABSTRACT

A cut pile fabric with substantially vertically standing tufts made of a synthetic multifilament yarn which is an intermingled yarn comprised of (a) a crimped multifilament yarn and (b) a non-crimped highly heat-shrinkable multifilament yarn having a heat shrinkage larger than that of the crimped multifilament yarn (a), and having thick portions and thin portions, alternately occurring along the length of each constituting filament of the yarn (b), said thick portions having a heat shrinkage larger than that of said thin portions. When heat-treated, the cut pile fabric provides a high-and-low cut pile fabric having a unique appearance. Especially when tip portions of cut piles of the crimped multifilament yarn (a) are entangled with each other, a cut pile fabric having a rugged surface with lumps of snarled piles is obtained.

9 Claims, 2 Drawing Sheets

HIGH AND-LOW PILES-REVEALING CUT PILE FABRIC CUT PILE FABRIC, HAVING RUGGED SURFACE WITH SNARLED PILES AND PROCESS FOR PRODUCING SAME

TECHNICAL FIELD

This invention relates to a cut pile fabric. More particularly, it relates to a high-and-low piles-revealing cut pile fabric with substantially vertically standing tufts, a cut pile fabric having a rugged surface with lumps of snarled cut piles, and a process for producing the cut pile fabric having a rugged surface with lumps of snarled cut piles.

BACKGROUND ART

Cut pile fabrics made from a non-crimped multifilament yarn, a crimped multifilament yarn, or a spun yarn have heretofore been known and used. These cut pile fabrics have problems in surface appearance such as occurrence of cracks, wale streaks, fiber falling and white glazing by reflection as observed at a certain visual angle.

To solve the problems in surface appearance of the conventional cut pile fabrics, a pile fabric made of an intermingled yarn wherein crimped synthetic multifilament yarns and non-crimped synthetic multifilament yarns are uniformly intermingled has been proposed in Japanese Unexamined Patent Publication No. H7-44758. The non-crimped yarns and the crimped yarns are uniformly intermingled in the cut piles of this fabric, and thus, crimp characteristics of the crimped yarn and smoothness and stiffness characteristics of the non-crimped yarn are manifested whereby the above-mentioned problems in surface appearance are solved. However, in the thus-proposed cut pile fabric composed of uniformly intermingled crimped yarns and non-crimped yarns, only a mean value of the characteristics of the crimped yarns and those of the non-crimped yarns is manifested.

No technical idea has heretofore been proposed wherein non-crimped yarns having special properties and crimped yarns having special properties are used in combination for the pile yarns of a cut pile fabric to provide a cut pile fabric with a novel and unique surface appearance.

DISCLOSURE OF INVENTION

A primary object of the present invention is to provide a fabric having a rugged surface with lumps of snarled piles and exhibiting a unique surface appearance.

Another object of the present invention is to provide a process for making the fabric with a rugged surface with lumps of snarled piles.

The present invention is based on the following technical ideas. Namely, first, cut piles of a fabric are made of an intermingled yarn of (a) a crimped synthetic multifilament yarn and (b) a non-crimped highly heat-shrinkable synthetic multifilament yarn which has thick portions and thin portions, alternately occurring along the length of each constituent filament of the yarn (b), the thick portions having a heat shrinkage larger than that of the thin portions, and thus, when the cut pile fabric is heat-treated, high-and-low cut piles are revealed; and secondly, at least tip portions of the cut piles of the crimped yarns are entangled with each other, and thus, a rugged surface with lumps of snarled piles is manifested.

Thus, in one aspect of the present invention, there is provided a high-and-low piles-revealing cut pile fabric with substantially vertically standing tufts, made of a synthetic multifilament yarn, characterized in that said synthetic multifilament yarn is an intermingled yarn comprised of (a) a crimped multifilament yarn and (b) a non-crimped highly heat-shrinkable thick-and-thin multifilament yarn having a heat shrinkage larger than that of the crimped multifilament yarn (a), and having thick portions and thin portions, alternately occurring along the length of each constituent filament of the yarn (b), said thick portions having a heat shrinkage larger than that of said thin portions.

In another aspect of the present invention, there is provided a cut pile fabric having a rugged surface with lumps of snarled piles of synthetic multifilament yarn, characterized in that said synthetic multifilament yarn is an intermingled yarn comprised of (a) a crimped multifilament yarn and (b) a non-crimped thick-and-thin multifilament yarn having a heat shrinkage larger than that of the crimped multifilament yarn (a), and having thick portions and thin portions, alternately occurring along the length of each constituent filament of the yarn (b); at least tip portions of piles of the crimped multifilament yarn (a) within the piles of the intermingled multifilament yarn are entangled with each other within each lump of the piles and/or between adjacent lumps of the piles.

In a further aspect of the present invention, there is provided a process for making a cut pile fabric having a rugged surface with lumps of snarled piles, characterized in that the above-mentioned high-and-low piles-revealing cut pile fabric with substantially vertically standing tufts is heat-treated whereby said non-crimped highly heat-shrinkable thick-and-thin multifilament yarn (b) having thick portions and thin portions, alternately occurring along the length of each constituent filament of the yarn (b) is shrunk, and at least tip portions of piles of the crimped multifilament yarn (a) are entangled with each other within each lump of piles and/or between adjacent lumps of cut piles.

BEST MODE FOR CARRYING OUT THE INVENTION

Figure 1:
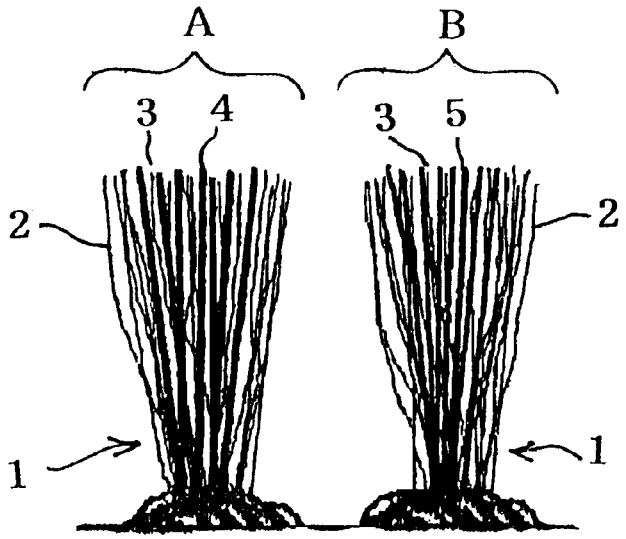
FIG. 1 is an enlarged detail of a fragmentary side elevation illustrating cut piles of the high-and-low cut piles-revealing cut pile fabric of the invention.

In FIG. 1 illustrating cut piles of the high-and-low cut piles-revealing fabric with substantially vertically standing tufts, of the invention, a lump of cut piles A and a lump of cut piles B are comprised of a synthetic multifilament yarn 1. The synthetic multifilament yarn 1 is an intermingled yarn comprised of a crimped multifilament yarn 2 and a non-crimped highly heat-shrinkable thick-and-thin multifilament yarn 3 having a heat shrinkage larger than that of the crimped multifilament yarn 2, and having thick portions and thin portions in each constituent filament, wherein the thick portions have a heat shrinkage larger than that of the thin portions. By the term "thick-and-thin multifilament yarn" we mean that the multifilament yarn has thick portions and thin portions, alternately occurring along the length of each constituent filament of the yarn.

In FIG. 1, the lump of cut piles A is predominantly comprised of thick portions 4 of the non-crimped thick-and-thin multifilament 3 and the crimped multifilament 2. The lump of cut piles B is predominantly comprised of thin portions 5 of the non-crimped thick-and-thin multifilament 3 and the crimped multifilament 2.

Figure 2:
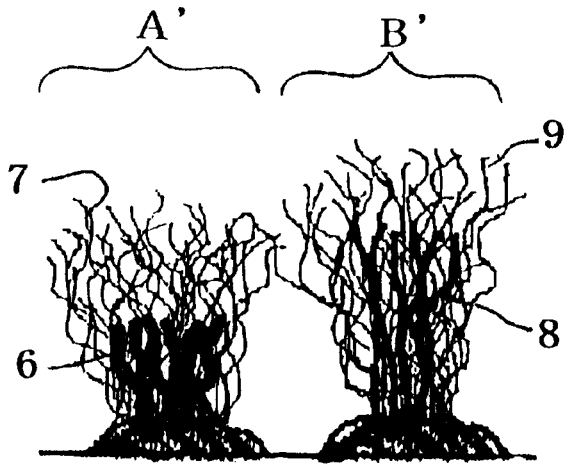
FIG. 2 is an enlarged detail of a fragmentary side elevation illustrating cut piles of one example of the high-and-low cut pile fabric having a rugged surface with lumps of snarled cut piles of the invention.

In FIG. 2, cut piles of the high-and-low cut pile fabric of the invention are illustrated, which fabric is obtained by heat-treating the high-and-low cut piles-revealing cut pile fabric illustrated in FIG. 1.

The lump of cut piles A illustrated in FIG. 1 becomes a lump of shortened cut piles A' illustrated in FIG. 2 by carrying out a heat-treatment under conditions such that the thick portion 4 of the non-crimped yarn 3 is shrunk. Namely, the thick filament portion 4 exhibits a large shrinkage, and thus, when heat-treated, it forms a cut pile 6 which is thicker and shorter than the non-heat-treated filament portion 4. The crimped multifilament 2 is shrunk accompanying the shrinkage of the thick filament portion 4, to form a relatively short cut pile 7. The shrinkage of the crimped multifilament 2 is due to the development of possible latent crimp and its own heat shrinkage, caused by the heat-treatment, and further due to entanglement thereof with the thick portion 4 of the non-crimped multifilament yarn 3 shrinking due to the heat-treatment.

The lump of cut piles B illustrated in FIG. 1 becomes a lump of cut piles B', as illustrated in FIG. 2, which have an approximately the same length as or slightly shorter length than that of the piles B. Namely, the thin portion 5 of the non-crimped yarn exhibits a shrinkage smaller than that of the thick portion 4 of the non-crimped yarn, and thus, the thin portion 5 becomes a cut pile 8 longer than the lump of cut piles A'. The crimped multifilament 2 mixed with the thin filament portion 5 in the lump of cut piles B in FIG. 1, remains as a relatively long cut pile 9, as illustrated in FIG. 2, without accompanying the shrinkage of the thin filament portion 4.

As described above, by heat-treating the cut pile fabric shown in FIG. 1, the lumps of cut piles A and the lump of cut piles B as illustrated in FIG. 2 form a lump of relatively short cut piles A' and a lump of relatively long cut piles B', respectively, as illustrated in FIG. 2.

Figure 3:
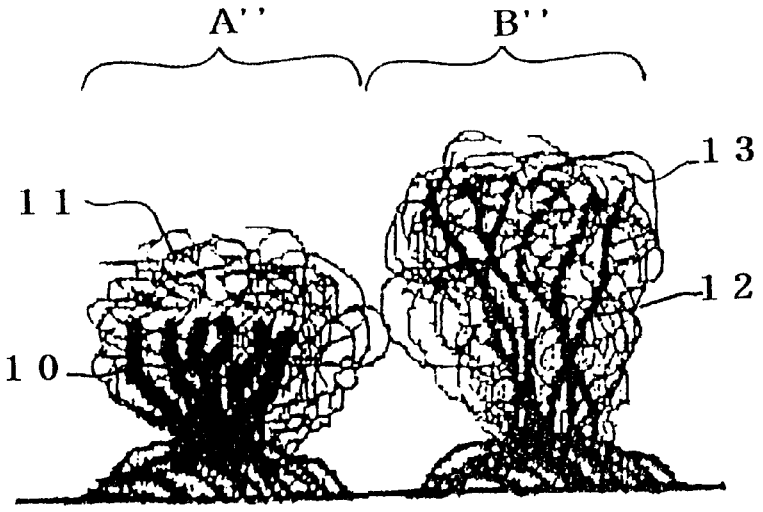
FIG. 3 is an enlarged detail of a fragmentary side elevation illustrating cut piles of another example of the high-and-low cut pile fabric having a rugged surface with lumps of snarled piles of the invention.

In FIG. 3, piles of another example of the high-and-low cut pile fabric of the invention are illustrated in a manner similar to in FIG. 2, which is obtained by heat-treating the high-and-low cut piles-revealing cut pile fabric, illustrated in FIG. 1, under conditions such that the non-crimped thick-and-thin multifilament 3 is shrunk. More specifically, the cut piles are illustrated in FIG. 3 which are characterized as comprising high-and-low piles and having a rugged surface with lumps of snarled cut piles, and which are formed by heat-treating a high-and-low cut piles-revealing cut pile fabric shown in FIG. 1 wherein a fine multifilament with a single filament thickness of not larger than 1 denier is used as the crimped multifilament yarn 2.

The lumps of cut piles A" and B" as illustrated in FIG. 3 are formed from the lumps of cut piles A and B as illustrated in FIG. 1, respectively, wherein the crimped multifilament yarn 2 is composed of fine multifilaments having a single filament thickness not larger than 1 denier. In this case, high cut piles and low cut piles are formed based on a principle similar to that explained above with reference to FIG. 2 wherein the piles are formed by heat-treating the piles illustrated in FIG. 1. Further, the crimped multifilaments 2 have a very fine single filament thickness, and therefore, at least tip portions of the piles of the crimped multifilaments 2 are readily entangled within each lump of cut piles and/or between the adjacent lumps of cut piles, whereby the lump of piles A (FIG. 1) becomes the lump of snarled low piles A" comprised of thick and short multifilament portions 10 and snarled crimped multifilaments 11 (FIG. 3), and the lump of piles B (FIG. 1) becomes the lump of snarled relatively high piles B" comprised of relatively thin and relatively long multifilament portions 12 and snarled crimped multifilaments 13 (FIG. 3). Thus the cut pile fabric having a rugged surface with lumps of snarled piles of the invention is obtained.

Typical embodiments of the invention have been above described with reference to FIG. 1 to FIG. 3, but the invention includes modified embodiments. For example, the lump of cut piles A and the lump of cut piles B, illustrated in FIG. 1, can be modified so that both of the thick filament portion 4 and the thin filament portion 5 are present as the non-crimped multifilament yarn 3 in each of the cut pile lumps A and B. In this case, when the high-and-low cut piles-revealing cut pile fabric is heat-treated, a cut pile fabric having a rugged surface with lumps of snarled piles is obtained, which has cut pile lumps having different pile lengths which are longer than that of the cut piles A' illustrated in FIG. 2 but are shorter than that of the cut piles B' illustrated in FIG. 2, wherein the lengths of the resulting cut piles vary depending upon the proportion of the two kinds of cut pile lumps.

As other modifications, the invention include an embodiment using two different kinds of cut pile lumps (i.e., cut pile lumps comprising the thick filament portions and cut pile lumps comprising the thin filament portions) wherein one kind of of cut pile lump is surrounded by a plurality of the other kind of cut pile lumps. According to this embodiment, the size of the lumps of long piles appears different from the size of the lumps of short piles. For example, when a lump of cut piles comprising the thick filament portion is surrounded by adjacent lumps predominantly comprised of cut piles comprising the thin filament portion 5 as the non-crimped multifilament 3 (as lump of cut piles B illustrated in FIG. 1), the cut pile fabric of a rugged surface with lumps of snarled piles looks to be comprised of large lumps of long piles. In contrast, when a lump of cut piles comprising the thin filament portion is surrounded by adjacent lumps predominantly comprised of cut piles comprising the thick filament portion 4 as the non-crimped multifilament 3 (as lump of cut piles A illustrated in FIG. 1), the cut pile fabric of a rugged surface with lumps of snarled piles looks to be comprised of short piles. Thus, various sizes of lumps comprising piles with desired length can be obtained from the non-crimped thick-and-thin multifilament. The invention further include another embodiment using two different kinds of cut pile lumps wherein one kind of cut pile lump is surrounded by a plurality of the other kind of cut pile lumps comprising the thick filament portion and the thin filament portion.

Figure 4:
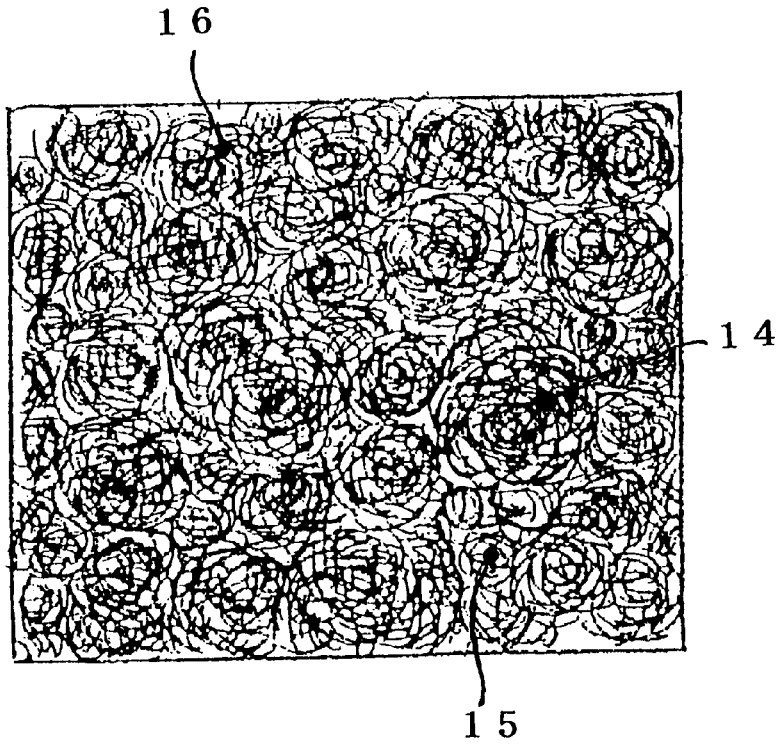
FIG. 4 is an enlarged plan view of the high-and-low cut pile fabric shown in FIG. 3.

In a further embodiment of the invention, a fine multifilament yarn having a single filament thickness of not larger than 1 denier is used as the crimped multifilament yarn 2. In this case, a high-and-low cut pile fabric comprised of lumps of snarled piles having an appearance of large size and lumps of snarled piles having an appearance of small size, which are distributed over the fabric surface, is obtained. One example of this embodiment is illustrated in FIG. 4 wherein reference numerals 14, 15 and 16 signify a lump of snarled piles having an appearance of large size, a lump of snarled piles having an appearance of small size, and a lump of snarled short piles, respectively.

Preferred embodiments of the intermingled multifilament yarn used for making the high-and-low cut piles-revealing cut pile fabric with substantially vertically standing tufts of the invention will now be described in detail.

The intermingled multifilament yarn preferably has a thickness of 75 to 250 deniers. If the thickness of the intermingled multifilament yarn is smaller than 75 deniers, when the yarn is knitted by using, for example, a high gauge sinker pile knitting machine with at least 28 gauge, the stitches are not dense enough, and thus, the cut piles become coarse with the result of reduction in quality of the cut pile fabric. In contrast, if the thickness of the intermingled multifilament yarn exceeds 250 deniers, when knitted, the shrinking stress of the yarn per density is undesirably large and the knitted structure shrinks to a great extent, resulting deterioration of feel of the cut pile fabric.

The proportion of the non-crimped multifilament yarn to the crimped multifilament yarn in the intermingled yarn is preferably in the range of 20:80 to 70:30 by weight, more preferably 35:65 to 50:50 by weight. If the amount of the non-crimped yarn is too small, it is insufficient to form the intended high-and-low piles. In contrast if the amount of the non-crimped yarn is too large, the feel of the fabric becomes stiff.

The difference in heat shrinkage between the non-crimped multifilament yarn and the crimped multifilament yarn in the intermingled yarn is preferably in the range of 20 to 60%, more preferably 30 to 50%. If the difference in heat shrinkage is smaller than 20%, the difference in height between the high piles and the low piles in the high-and-low cut pile fabric becomes small. In contrast if the difference in heat shrinkage is larger than 60%, the difference in height between the long piles and the short piles in the high-and-low cut pile fabric becomes undesirably large and the short piles become difficult to support the long piles occasionally resulting lying down of long piles.

The heat shrinkage of the non-crimped multifilament yarn in the intermingled yarn is preferably in the range of 50 to 70%. The thick portion and thin portion of each constituent filament of the non-crimped multifilament yarn preferably have a heat shrinkage of 50 to 90% and 30 to 70%, respectively. Both the thick portion and thin portion of each constituent filament of the non-crimped multifilament yarn preferably have a length of 2 mm to 35 mm, more preferably a length of 5 mm to 20 mm. If the lengths of the thick and thin filament portions are outside this range, the long and short piles on the fabric are undesirably unbalanced and the appearance of the fabric is damaged. To cite one example, when a non-crimped thick-and-thin multifilament having an average single filament thickness of 1.6 denier, an average thick portion thickness of 2 denier and an average thin portion of 1.5 denier is used, a high-and-low cut pile fabric made by weaving or knitting into a cut pile fabric and heat-treating the fabric has the non-crimped multifilament with a thick portion thickness of 5 to 12 denier and a thin portion thickness of 2 to 7 denier.

As specific examples of the non-crimped multifilament yarn, there can be mentioned an undrawn multifilament yarn, a partly drawn multifilament yarn, and a highly shrinkable thick-and-thin multifilament yarn obtained by drawing so-called POY at a temperature not higher than the glass transition temperature, which yarns are made of polyester or other synthetic polymers.

As specific examples of the crimped multifilament yarn in the intermingled yarn, there can be mentioned a false-twisted crimped yarn, a stuff-crimped yarn and a knit-and-deknitted crimped yarn. Of these, a false-twisted crimped yarn is preferable. The crimped multifilament yarn preferably has a percentage crimp of 0.5 to 10%. If the percentage crimp exceeds 10%, the feel becomes stiff. In contrast if the percentage crimp is smaller than 0.5%, the desired lump of snarled piles is difficult to form even when a fine multifilament yarn having a single filament thickness not larger than 1 denier is used. Preferably the heat shrinkage of the crimped yarn is in the range of 2 to 20%. If the heat shrinkage exceeds 20%, the high-and-low cut pile fabric is difficult to make. In contrast the heat shrinkage is smaller than 2%, the desired lump of snarled piles is difficult to form even when a fine multifilament yarn having a single filament thickness not larger than 1 denier is used.

The intermingled multifilament yarn is prepared by, for example, paralleling-and-interlacing, or doubling-and-twisting. Of these, paralleling-and-interlacing is most suitable for the formation of the high-and-low cut pile fabric.

Cut piles can be made from the intermingled multifilament yarn by a method wherein piles are cut from a pile structure knitted from sinker pile or double raschel at the knitting step; a method wherein a pile structure is made from a tricot knitted fabric by a raising machine, and then piles are cut from the pile structure; or a method wherein a moquette is woven from the yarn and then the piles of the moquette are cut.

The heat-treatment for forming long piles and short piles can be conducted either by a wet heat treatment or a dry heat-treatment. The wet heat-treatment is effected preferably at a temperature of 80 to 130° C., more preferably 100 to 110° C. At a temperature lower than 80° C., the long piles and short piles are difficult to form. In contrast, at a temperature higher than 130° C., the fabric is shrunk to an excessive extent and the feel becomes stiff.

The piles in the cut pile lump A and the cut pile lump B, illustrated in FIG. 1, preferably has a length of 0.8 to 5 mm, more preferably 1.2 to 3 mm. If the pile length is smaller than 0.8 mm, the difference in length between the pile lump A and the pile lump B in FIG. 2 and between the pile lump A" and the pile lump B" in FIG. 3 are insufficient for providing the desired high-and-low cut pile fabric. In contrast if the pile length is longer than 5 mm, the piles are apt to undesirably lie down on the fabric.

The high-and-low cut pile fabric having long piles and short piles, developed by the heat-treatment, is dyed by, for example, a liquid stream circulating dyeing machine, and then dyed and set.

The high-and-low cut pile fabric having a rugged surface with lumps of snarled piles of the invention will now be specifically described by the following example.

In the example, the boiling-off water shrinkage (BWS) was measured by the following method. A hank sample was prepared by rotating a sizing reel with a peripheral length of 1.125 m ten times. The hank was hung on a hook on a scale board, and a measuring load [=filament thickness in denier× 1/31×10×2] is applied to the lower end of the hank. The length $L_1$ of the hank is measured. Then the measuring load is removed, and the hank is placed in a cotton bag and immersed in a boiling water bath for 30 minutes. Then the cotton bag is taken from the bath, and the hank is taken out from the bag. Water is removed from the hank by using a filter paper and the hank is air-dried for 24 hours. The hank is again hung on the hook of the scale board, the measuring load is applied to the lower end of the hank. The length $L_2$ of the hank is measured.

$$BWS\ (\%)=[(L_1-L_2)/L_1]\times 100$$

EXAMPLE

Chips of polyethylene terephthalate were melt-spun at 280° C. and taken-up by a first take-up roller rotating at a speed of 1,700 m/min and a second take-up roller rotating at a speed of 2,700 m/min to give a thick-and-thin multifilament yarn with 165 denier/72 filaments having an elongation of 250%. The thick-and-thin multifilament yarn was cold-drawn 1.4 times their original length to prepare a thick-and-thin multifilament yarn with 115 denier/72 filaments. The multifilament yarn had an average boiling-off water shrinkage (BWS) of 60%. The thick portion of each constituent filament had a BWS of 80% and an average length of 15 mm, and the thin portion thereof had a BWS of 50% and an average length of 15 mm.

Chips of polyethylene terephthalate were melt-spun at 290° C. and taken-up by a first take-up roller rotating at a speed of 6,000 m/min and a second take-up roller rotating at a speed of 6,000 m/min to give a partially oriented uniform multifilament yarn (POY) with 85 denier/144 filaments having an elongation of 130%. The partially oriented uniform multifilament yarn was subjected to a simultaneous draw false twist crimping at a draw ratio of 1.4, a false twisting temperature of 110° C., a heater length of 1.5 m, a surface speed of a false twist disk (triplet-axis circular frictional false twisting plate) of 600 m/min and a false twist speed of 300 m/min to prepare a false-twisted crimped multifilament yarn with 64 denier/144 filaments having a percentage crimp of 1.4%.

The above-mentioned thick-and-thin multifilament yarn and the above-mentioned false-twisted crimped multifilament yarn were intermingled together by a paralleling-and-interlacing method using an interlace nozzle at a compression air pressure of 2 kg/cm$^2$, an overfeed ratio of 2% and an intermingling speed of 300 m/min to prepare an intermingled multifilament yarn with 189 denier/216 filaments having a BWS of 58% and an intermingling degree of 90 per meter.

Using a Karl-Meyer warp knitting machine provided with pole sinkers, a non-crimped polyester multifilament yarn with 150 deniers/48 filaments to be knitted into a knitted fabric as a ground structure, and the above-mentioned intermingled multifilament yarn to be formed into a pile structure were arranged in a full-set manner in yarn guides of the knitting machine, and knitted at a density of 65 courses/inch into a knitted fabric having loop piles with a 2 mm size made of the intermingled multifilament yarn composed of the highly shrinkable yarn and the lowly crimped yarn and having a total thickness of 189 deniers.

The piles on the fabric were cut to remove the tip portions having a length of 0.2 mm of the respective piles by using a shearing machine made by JGC Corporation to give a cut pile fabric with a velours appearance. The cut pile fabric in the spread state was heat-treated at 180° C. for 45 seconds by using a dry-heating setter.

The heat-treated fabric was then dyed at 130° C. for 45 minutes by using a liquid-stream circulating dyeing machine made by Hisaka Works Ltd. and dried at 120° C. for 1 minute by using a short loop dryer made by Hirano Tecseed Co., Ltd. After the drying, the fabric was heat-treated at a temperature of 170° C. for 45 seconds by using a dry-heating setter to remove wrinkles occurring during the dyeing. The thus-made fabric had a rugged surface with lumps of snarled piles, as illustrated in FIG. 3.

INDUSTRIAL APPLICABLILTY

The high-and-low cut piles-revealing fabric with substantially vertically standing tufts of the invention gives a high-and-low cut pile fabric having a unique appearance. Especially when the tip portions of cut piles of the crimped filament yarn are entangled with each other, a cut pile fabric having a rugged surface with lumps of snarled piles is obtained.

The high-and-low pile cut fabric and the cut pile fabric having a rugged surface with lumps of snarled piles, which are made from the high-and-low cut piles-revealing fabric of the invention, are useful as upholstery fabrics and other interior materials in automobiles and other uses.

What is claimed is:

1. A high-and-low piles-revealing cut pile fabric with substantially vertically standing tufts made of a synthetic multifilament yarn, wherein said synthetic multifilament yarn is an intermingled yarn comprised of (a) a crimped multifilament yarn and (b) a non-crimped highly heat-shrinkable thick-and-thin multifilament yarn having a heat shrinkage larger than that of the crimped multifilament yarn (a), and having thick portions and thin portions, alternately occurring along the length of each constituting filament of the non-crimped multifilament yarn (b), said thick portions having a heat shrinkage larger than that of said thin portions.

2. The cut pile fabric according to claim 1, which has, on a piles-revealing surface, a plurality of piles A predominantly comprised of (i) the thick portions of each constituting filament of the non-crimped highly heat-shrinkable thick-and-thin multifilament yarn (b) and (ii) the crimped multifilament yarn, and a plurality of piles B predominantly comprised of (i) the thin portions of each constituting filament of the non-crimped highly heat-shrinkable thick-and-thin multifilament yarn (b) and (ii) the crimped multifilament yarn (a).

3. The cut pile fabric according to claim 1, wherein the intermingled multifilament yarn has a thickness of 75 to 250 denier, and the difference in heat-shrinkage between the non-crimped multifilament yarn (b) and the crimped multifilament yarn (a) is in the range of 20 to 60% and the ratio of (b)/(a) is in the range of 20/80 to 70/30 by weight.

4. A high-and-low cut pile fabric made by subjecting the cut pile fabric as claimed in any one of the claims 1 to 3 to a heat treating.

5. A cut pile fabric having a rugged surface with lumps of snarled cut piles of synthetic multifilament yarn, wherein said synthetic multifilament yarn is an intermingled yarn comprised of (a) a crimped multifilament yarn and (b) a non-crimped thick-and-thin multifilament yarn having a heat shrinkage larger than that of the crimped multifilament yarn (a), and having thick portions and thin portions, alternately occurring along the length of each constituent filament of the yarn (b); at least tip portions of cut piles of the crimped multifilament yarn (a) within the non-crimped multifilament cut piles of the intermingled multifilament yarn are entangled with each other within each lump of cut piles and/or between adjacent lumps of cut piles.

6. A process for making a cut pile fabric having a rugged surface with lumps of snarled piles, comprising the step of:

heat-treating a high-and-low piles-revealing cut pile fabric with tufts standing vertically made of a synthetic multifilament yarn, wherein the synthetic multifilament yarn is an intermingled multifilament yarn comprised of (a) a crimped multifilament yarn and (b) a non-crimped highly heat-shrinkable thick-and-thin multifilament yarn having a heat shrinkage larger than that of the crimped multifilament yarn (a) and having thick portions and thin portions, alternately occurring along the length of each constituent filament of the non-crimped multifilament yarn (b), the thick portions have a heat shrinkage larger than that of the thin portions, the non-crimped multifilament yarn (b) is shrunk, and at least tip portions of cut piles of the crimped multifilament yarn (a) are entangled with each other within each lump of cut piles and/or between adjacent lumps of cut piles.

7. A process for making a cut pile fabric having a rugged surface with lumps of snarled cut piles according to claim 6, wherein the intermingled multifilament yarn has a thickness of 75 to 250 denier, and the difference in heat-shrinkage between the non-crimped multifilament yarn (b) and the crimped multifilament yarn (a) is in the range of 20 to 60% and the ratio of (b)/(a) is in the range of 20/80 to 70/30 by weight.

8. A process for making a cut pile fabric having a rugged surface with lumps of snarled cut piles according to claim 6, wherein the crimped multifilament yarn (a) has a single filament thickness not larger than 1 denier.

9. A process for making a cut pile fabric having a rugged surface with lumps of snarled cut piles according to claim 6, wherein the heat treatment is carried out under moist heat conditions at a temperature of 80 to 130° C. or dry heat conditions at a temperature of 130 to 200° C.

* * * * *